US009244422B2

(12) United States Patent
Tsuji

(10) Patent No.: US 9,244,422 B2
(45) Date of Patent: Jan. 26, 2016

(54) CLEANING DEVICE AND IMAGE FORMING APPARATUS

(71) Applicant: KYOCERA Document Solutions Inc., Osaka (JP)

(72) Inventor: Hirofumi Tsuji, Osaka (JP)

(73) Assignee: KYOCERA DOCUMENT SOLUTIONS INC., Osaka (JP)

( * ) Notice: Subject to any disclaimer, the term of this patent is extended or adjusted under 35 U.S.C. 154(b) by 0 days.

(21) Appl. No.: 14/719,373

(22) Filed: May 22, 2015

(65) Prior Publication Data

US 2015/0346674 A1 Dec. 3, 2015

(30) Foreign Application Priority Data

May 27, 2014 (JP) ..... 2014-108865

(51) Int. Cl.
*G03G 21/00* (2006.01)
*G03G 21/10* (2006.01)

(52) U.S. Cl.
CPC ..... *G03G 21/0011* (2013.01); *G03G 21/007* (2013.01); *G03G 21/105* (2013.01)

(58) Field of Classification Search
CPC ..... G03G 21/0076; G03G 21/105; G03G 21/007; G03G 2221/1624
See application file for complete search history.

(56) References Cited

U.S. PATENT DOCUMENTS

| | | | | |
|---|---|---|---|---|
| 7,555,247 | B2 * | 6/2009 | Suenami | G03G 15/0822 399/254 |
| 8,224,213 | B2 * | 7/2012 | Takemoto | G03G 15/0808 399/254 |
| 9,176,455 | B2 * | 11/2015 | Fujii | G03G 21/0029 |
| 2013/0108341 | A1 | 5/2013 | Ikebata et al. | |

* cited by examiner

*Primary Examiner* — Gregory H Curran
(74) *Attorney, Agent, or Firm* — Wenderoth, Lind & Ponack, L.L.P.

(57) ABSTRACT

A toner crushing wire is disposed in a cleansing housing so as to extend along a rotating shaft of the cleaning roller. The toner crushing wire is allowed to swing along a cleaning housing inner wall facing the peripheral surface of the cleaning roller in non-contact with the cleaning housing inner wall. In this way, remaining toner scraped off from the peripheral surface of a photosensitive drum by a cleaning blade is crushed by the toner crushing wire.

6 Claims, 6 Drawing Sheets

CLEANING DEVICE AND IMAGE FORMING APPARATUS

BACKGROUND

The technology of the present disclosure relates to a cleaning device used in an image forming apparatus.

In this type of cleaning device, remaining toner remaining on the peripheral surface of a photosensitive drum after transfer is scraped off using a cleaning blade, and the peripheral surface of the photosensitive drum is abraded by an abrasive included in the scraped-off remaining toner by using a cleaning roller. Furthermore, the scraped-off remaining toner is discharged outside a cleaning housing by using a discharge screw as waste toner.

There has been proposed a technology in which a toner crushing member is provided to the discharge screw, and a flexible plate of the toner crushing member is allowed to abut fins of the discharge screw to crush remaining toner, so that the remaining toner is smoothly supplied to the screw.

SUMMARY

A cleaning device according to one aspect of the present disclosure includes a cleaning blade, a cleaning roller, and a discharge screw. The cleaning blade is provided in a cleansing housing and is brought into press-contact with the peripheral surface of a photosensitive drum to scrape off remaining toner from the peripheral surface, a toner image being formed on the peripheral surface of the photosensitive drum. The cleaning roller is provided in the cleansing housing at an upstream side of the rotation direction of the photosensitive drum from the cleaning blade, and is brought into press-contact with the peripheral surface of the photosensitive drum to abrade the peripheral surface of the photosensitive drum by an abrasive included in the scraped-off remaining toner. The discharge screw is provided in the cleansing housing below the cleaning roller to discharge the scraped-off remaining toner outside the cleansing housing as waste toner. In the cleansing housing, a toner crushing wire is disposed. The toner crushing wire is disposed so as to extend along a rotating shaft of the cleaning roller. The toner crushing wire swings along an inner wall of the cleansing housing facing a peripheral surface of the cleaning roller in non-contact with the inner wall of the cleansing housing and crushes the scraped-off remaining toner.

DETAILED DESCRIPTION

Hereinafter, an embodiment of the technology of the present disclosure will now be described with reference to the drawings.

Figure 1:
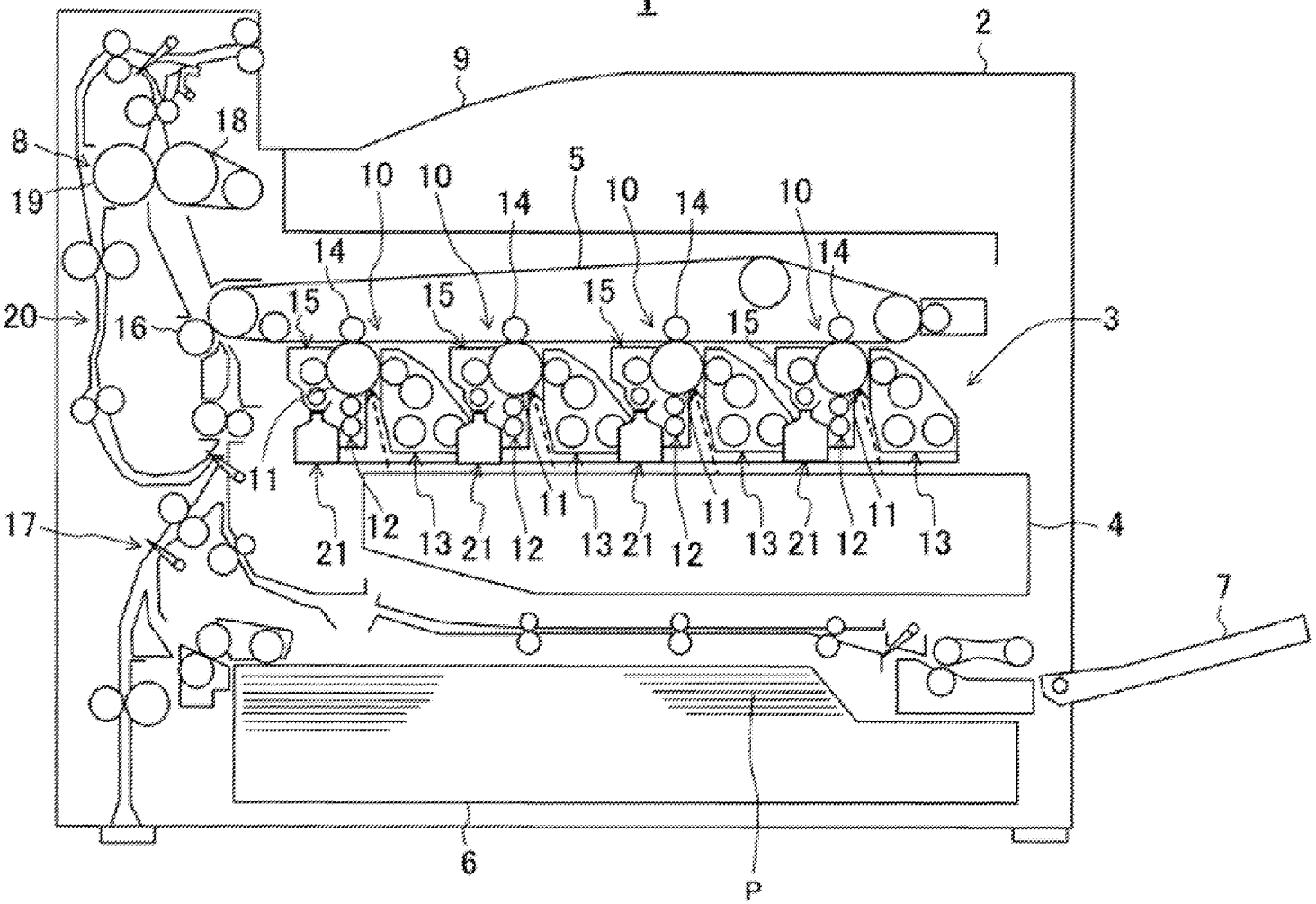
FIG. 1 is a schematic configuration diagram of an image forming apparatus employing a cleaning device according to an embodiment.

FIG. 1 illustrates a schematic configuration diagram of an image forming apparatus 1 employing a cleaning device according to an embodiment. The image forming apparatus 1 is a tandem type color printer and includes an image forming unit 3 in a box-like housing 2. The image forming unit 3 is a part that transfers an image to a recording paper P on the basis of image data transmitted from an external device such as a network-connected computer. Below the image forming unit 3, an exposure device 4 is disposed to irradiate laser light, and above the image forming unit 3, a transfer belt 5 is disposed. Under the exposure device 4, a paper storage unit 6 is disposed to store the recording paper P, and at a lateral side of the paper storage unit 6, a manual paper feeding unit 7 is disposed. Above the lateral side of the transfer belt 5, a fixing unit 8 is disposed to perform a fixing process on the image transferred to the recording paper P. A reference numeral 9 indicates a paper discharge unit disposed at an upper portion of the housing 2 to discharge the recording paper P subjected to the fixing process in the fixing unit 8.

The image forming unit 3 includes four image forming units 10 disposed in a row along the transfer belt 5. Each of the image forming units 10 has a photosensitive drum 11. Directly under each photosensitive drum 11, a charging device 12 is disposed, and at one lateral side of each photosensitive drum 11, a developing device 13 is disposed. Directly above each photosensitive drum 11, a primary transfer roller 14 is disposed, and at the other lateral side of each photosensitive drum 11, a cleaning unit (hereinafter, referred to as a cleaning device) 15 is disposed to clean a peripheral surface of each photosensitive drum 11.

The peripheral surface of each photosensitive drum 11 is uniformly charged by the charging device 12, and laser light corresponding to each color based on the image data input from the computer and the like is irradiated to the peripheral surface of each charged photosensitive drum 11 from the exposure device 4, so that an electrostatic latent image is formed on the peripheral surface of each photosensitive drum 11. A developer is supplied to the electrostatic latent image from the developing device 13, so that a yellow, magenta, cyan, or black toner image is formed on the peripheral surface of each photosensitive drum 11. These toner images are respectively superposed on and transferred to the transfer belts 5 by a transfer bias applied to the primary transfer roller 14.

A reference numeral 16 indicates a secondary transfer roller disposed below the fixing unit 8 in contact with the transfer belt 5, and the secondary transfer roller 16 is configured to interpose the recording paper P conveyed along a paper conveyance path 17 from the paper storage unit 6 or the manual paper feeding unit 7 between the secondary transfer roller 16 and the transfer belt 5, and to transfer the toner images of the transfer belt 5 to the recording paper P by a transfer bias applied to the secondary transfer roller 16.

The fixing unit 8 includes a heating roller 18 and a pressing roller 19, and is configured to heat and press the recording paper P while interposing the recording paper P between these heating roller 18 and pressing roller 19, thereby fixing the toner images, which have been transferred to the recording paper P, to the recording paper P. The recording paper P subjected to the fixing process is discharged to a paper discharge unit 9. A reference numeral 20 indicates a reversing conveyance path for reversing the recording paper P discharged from the fixing unit 8 at the time of duplex printing.

Below each cleaning device 15, a waste toner recovery container 21 is disposed. The waste toner recovery container is a container that collects remaining toner scraped off from the peripheral surface of the photosensitive drum 11 by the cleaning device 15 as waste toner.

Figure 2:
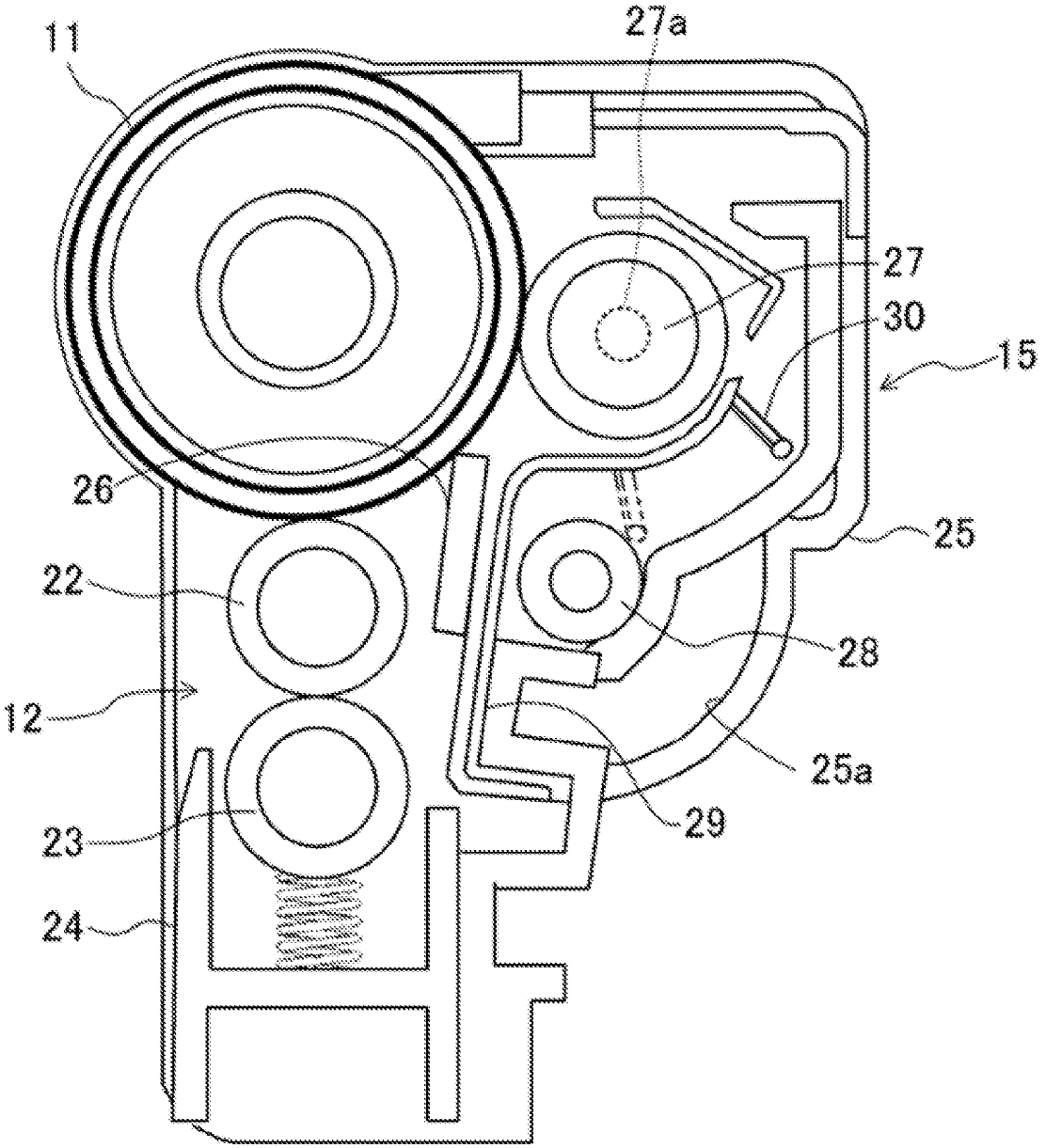
FIG. 2 is a sectional view illustrating a photosensitive drum, a charging device, and a cleaning device according to an embodiment of an image forming unit.

FIG. 2 illustrates the photosensitive drum 11, the charging device 12, and the cleaning device 15 of the image forming unit 10. In FIG. 2, the right and left direction on the paper surface of FIG. 1 is reversed.

The charging device 12 includes a charging roller 22, which abuts the peripheral surface of the photosensitive drum from the bottom and rotates while being driven with the photosensitive drum 11, a cleaning roller 23, which comes into slide contact with the peripheral surface of the charging roller 22 and cleans the peripheral surface, in a charging housing 24.

The cleaning device 15 includes a cleansing housing 25 opened toward the photosensitive drum 11. At an opening side of the cleansing housing 25, a cleaning blade 26 is disposed so as to be brought into press-contact with the peripheral surface of the photosensitive drum 11, and to scrape off remaining toner from the peripheral surface of the photosensitive drum 11 on which the toner image has been formed.

In the cleansing housing 25, a cleaning roller 27 is configured to be disposed at an upstream side in a rotation direction of the photosensitive drum 11 from the cleaning blade 26, and the cleaning blade 26 is configured to be brought into press-contact with the peripheral surface of the photosensitive drum 11, so that the peripheral surface of the photosensitive drum 11 is abraded (cleaned) by an abrasive included in the remaining toner scraped off by the cleaning blade 26. In this way, a discharge product and the like attached to the peripheral surface of the photosensitive drum 11 are removed.

A discharge screw 28 is configured to be disposed below the cleaning roller 27 at a lower portion of the cleansing housing 25, and the remaining toner scraped off by the cleaning blade 26 is configured to be discharged to and collected in the waste toner recovery container 21 (see FIG. 1) outside the cleansing housing 25 as waste toner by the rotation operation of the discharge screw 28. A reference numeral 29 indicates a partition plate provided between the cleaning roller 27 and the discharge screw 28 in order to block the inside of the cleansing housing 25, and the cleansing housing 25 and the charging housing 24 are partitioned by the partition plate 29.

In the cleansing housing 25, a toner crushing wire 30 including a conductive wire made of one spring steel is disposed so as to extend along a rotating shaft 27*a* of the cleaning roller 27.

Figure 3:
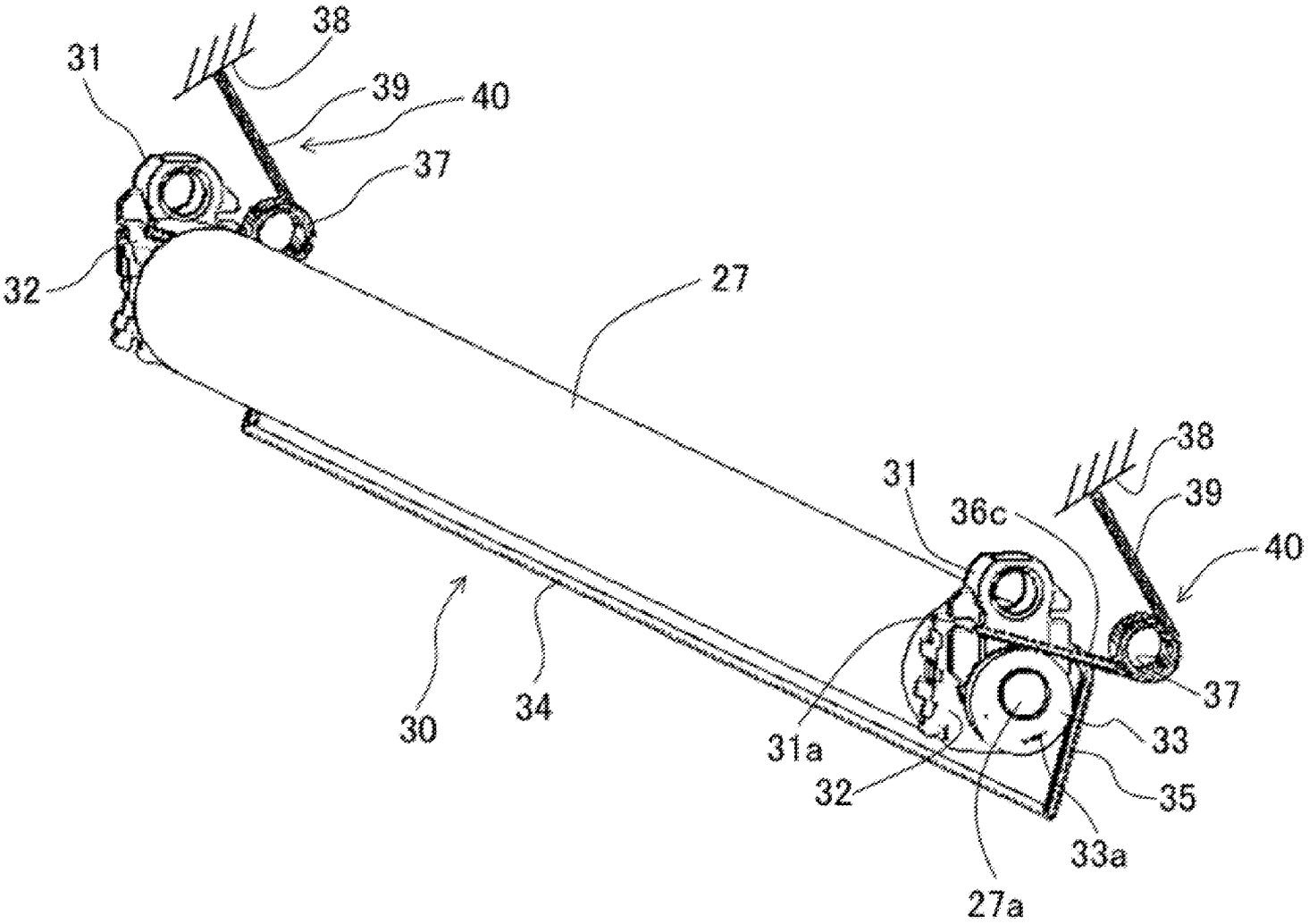
FIG. 3 is a perspective view illustrating a cleaning roller and a toner crushing wire of a cleaning device according to an embodiment.

In detail, as illustrated in FIG. 3, both ends of the rotating shaft 27*a* of the cleaning roller 27 are respectively supported to device fixing sides (not illustrated) via a holding member 31 and a bearing member 32, and cam members 33 are respectively fixed to both ends of the rotating shaft 27*a*. The cam member 33 is a disk cam having a cam portion 33*a*, and the cam portion 33*a* is set such that a distance from the rotating shaft 27*a* to the circumference is longer than that of other parts. Furthermore, the holding member 31 is formed with a slit 31*a* for locking the toner crushing wire 30.

Figure 6:
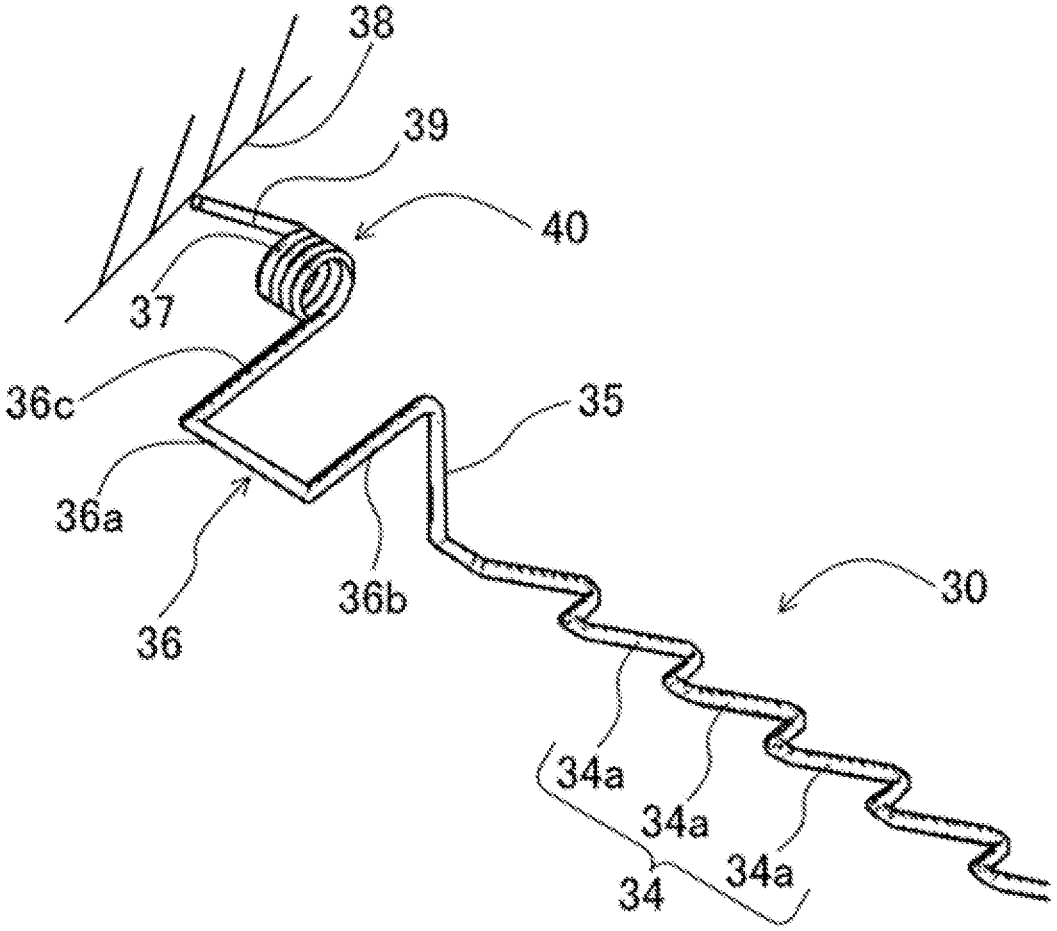
FIG. 6 is a perspective view illustrating another example 2 of a toner crushing wire.

On the other hand, the toner crushing wire 30 includes a wire body 34 that horizontally extends along a longitudinal direction of the cleaning roller 27 at a position adjacent to a lower portion of the cleaning roller 27, wherein at both ends of the wire body 34, first arm parts 35 are bent at a right angle, and at the first arm parts 35, bending parts 36 bent in an approximately U shape are continuously formed (see FIG. 6 of another example 2). Each bending part 36 includes a swing support portion 36*a* locked with the slit 31*a* of the holding member 31, a second arm 36*b* bent at a right angle from one end of the swing support portion 36*a* and continued to the first arm part 35, and an abutting portion 36*c* bent at a right angle from the other end of the swing support portion 36*a* and abutting the cam member 33. A spiral portion 37 is continued to the abutting portion 36*c*, and a ground terminal portion 39 touched to a device fixing side 38 and grounded is further continued to the spiral portion 37. That is, a twist coil spring 40 serving as a swing urging portion is configured by the abutting portion 36*c*, the spiral portion 37, and the ground terminal portion 39.

In this way, the toner crushing wire 30 is disposed such that the wire body 34 extends along the rotating shaft 27*a* of the cleaning roller 27, and both end sides (the swing support portions 36*a*) in the longitudinal direction are respectively fixed to the wire bodies 34. Furthermore, the vicinity (the abutting portion 36*c*) of the swing support portion 36*a* abuts the cam member 33 and both ends (the ground terminal portions 39) in the longitudinal direction abut the device fixing side 38.

Figure 4B:
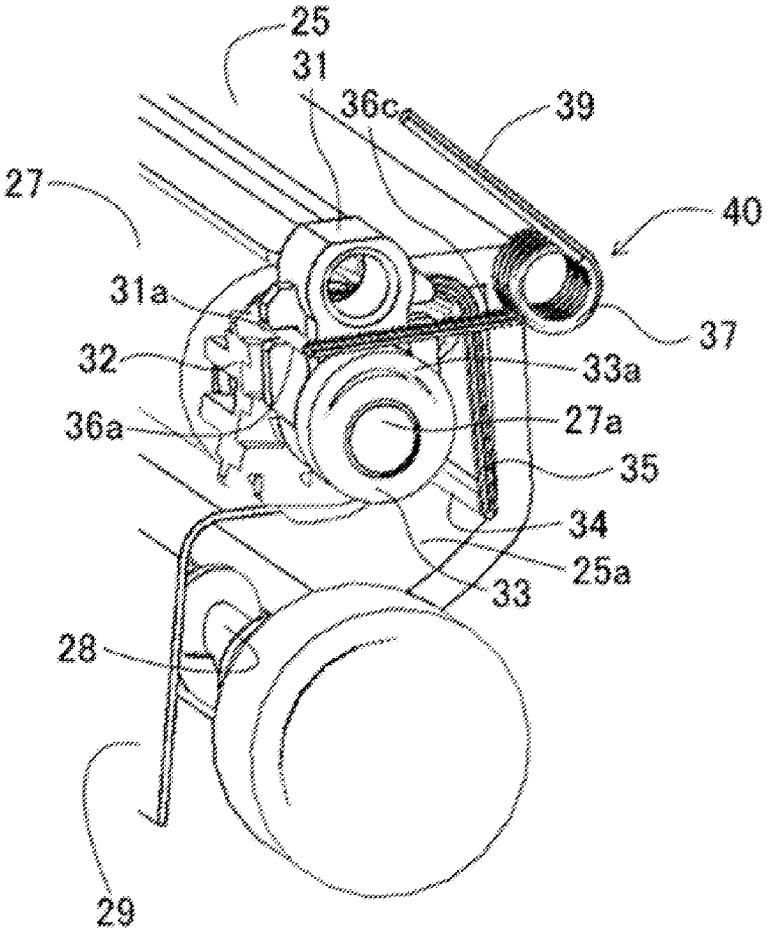
FIG. 4B illustrates a state in which a cleaning roller and a toner crushing wire have been received in a cleaning housing and a state in which a cam portion of a cam member has abutted the toner crushing wire in a cleaning device according to an embodiment.
Figure 4A:
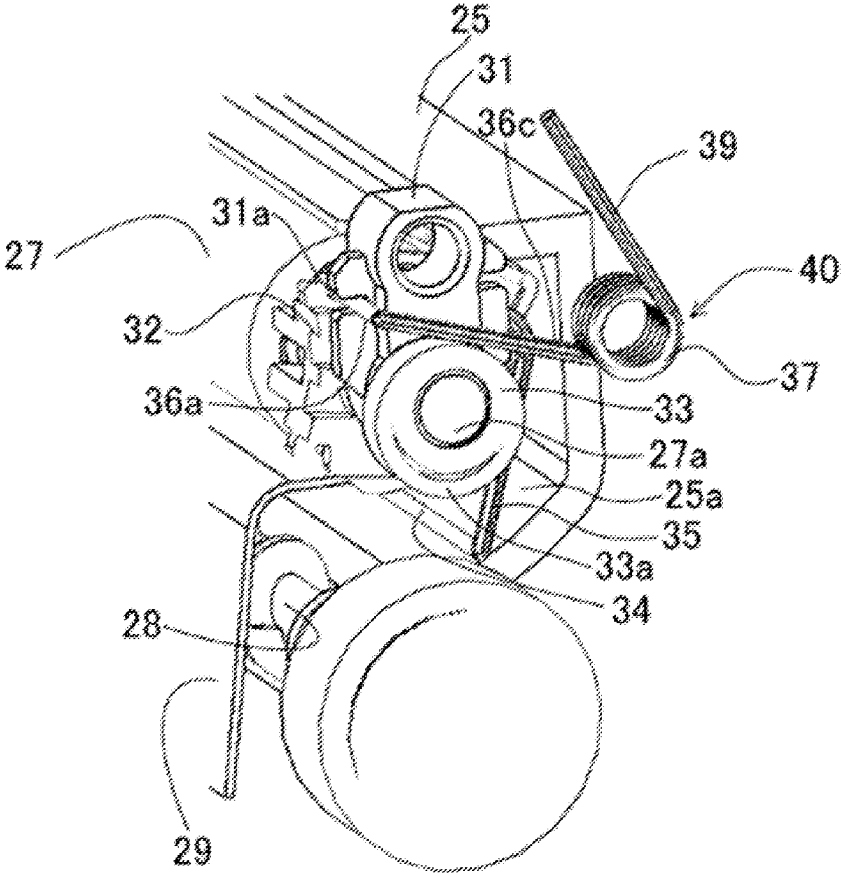
FIG. 4A illustrates a state in which a cleaning roller and a toner crushing wire have been received in a cleaning housing and a state before a cam portion of a cam member abuts the toner crushing wire in a cleaning device according to an embodiment.

The cam member 33 rotates with the rotation operation of the cleaning roller 27, so that the cam portion 33*a* passes through the abutting portion 36*c* of the wire body 34 as illustrated in FIG. 4A and FIG. 4B, and the wire body 34 vertically swings by employing the swing support portion 36*a* as a support point.

At this time, as indicated by a solid line and a virtual line of FIG. 2, the wire body 34 is configured to swing along a cleaning housing inner wall 25*a* facing the peripheral surface of the cleaning roller 27 in non-contact with the cleaning housing inner wall 25*a*, and to crush remaining toner (not illustrated) scraped off from the peripheral surface of the photosensitive drum 11 by the cleaning blade 26.

Consequently, it is possible to prevent the remaining toner from being attached to and accumulated/solidified in the inner wall 25*a* of the cleansing housing 25, and to reliably and smoothly discharge and collect the remaining toner to/in the waste toner recovery container 21 outside the cleansing housing 25 by the discharge screw 28 as waste toner.

Furthermore, the toner crushing wire 30 including one wire is allowed to swing along the cleaning housing inner wall 25*a* in non-contact with the cleaning housing inner wall 25*a*, so that it is possible to provide an inexpensive cleaning device 15 with a simple structure with no noise without generating contact sound with the inner wall 25*a* or slide sound with the fins of a discharge screw as with Patent Literature 1.

Moreover, the toner crushing wire 30 and the cam member are installed at the rotating shaft 27*a* of the cleaning roller 27, and the cam member 33 abutting the toner crushing wire 30 rotates with the rotation operation of the cleaning roller 27 to allow the toner crushing wire 30 to swing, so that it is possible to provide an economical and compact cleaning device 15 without using a separate dedicated driving source.

Moreover, the twist coil springs 40 are provided at both end sides of the toner crushing wire 30 in the longitudinal direction, so that the toner crushing wire 30 pushed up above the cam portions 33*a* of the cam members 33 can be forcibly returned to the original position by spring force of the twist coil springs 40, and can be reliably swung.

In addition, the toner crushing wire 30 including a conductive wire is grounded to the device fixing side 38, so that it is possible to prevent an image from being affected by leak pinhole and the like of charge of remaining toner, which has been escaped to the device fixing side 38, to the photosensitive drum 11.

Another Example 1 of Toner Crushing Wire

Figure 5:
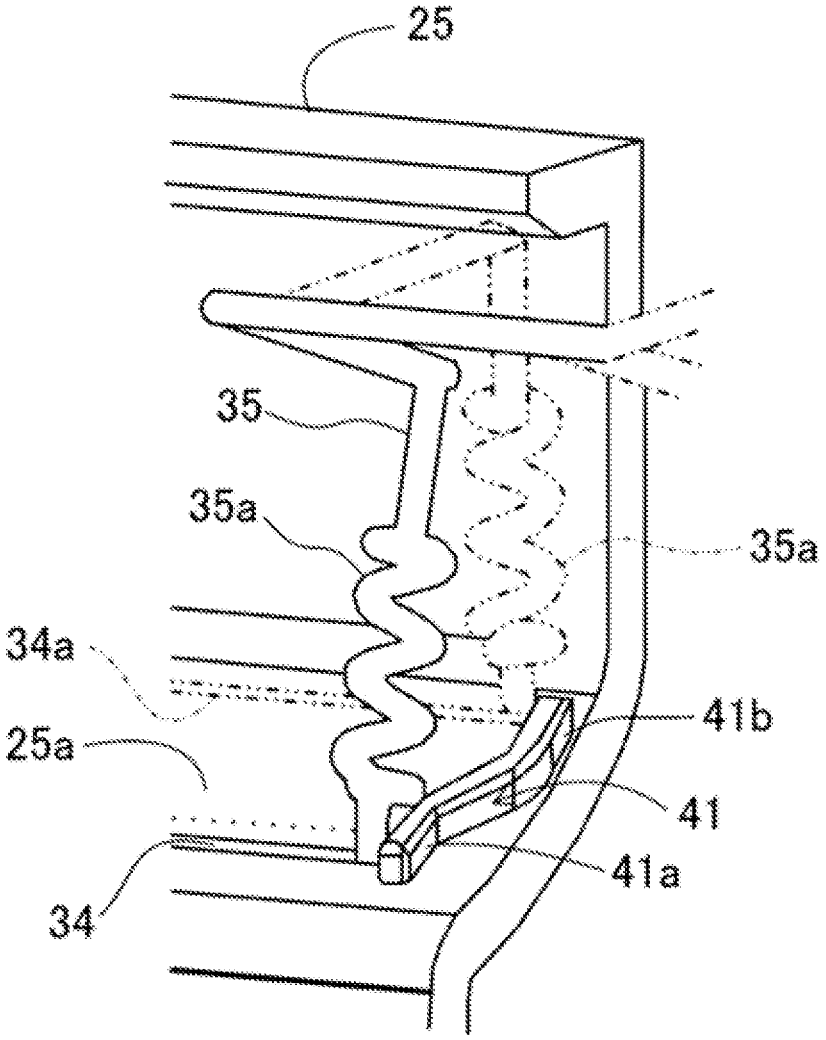
FIG. 5 is a perspective view illustrating a toner crushing wire of another example 1 received in a cleaning housing.

FIG. 5 illustrates another example 1 of the toner crushing wire 30.

At the first arm parts 35 of both end sides of the toner crushing wire 30 in the longitudinal direction, elastic portions 35*a* twisted in a spiral shape and having elasticity are respectively formed.

On the other hand, a guide portion 41 linearly protrudes at a lower end portion of the cleansing housing inner wall 25*a* corresponding to one end of the direction of the rotating shaft 27*a* of the cleaning roller 27, and is curved such that a lower end side 41*a* is positioned at an inner side of the toner crushing wire 30 in the longitudinal direction from an upper end side 41*b*.

In the state in which the cam portion 33*a* of the cam member 33 pushes up the abutting portion 36*c* of the toner crushing wire 30 as illustrated in FIG. 4B, an end portion (a lower end of the first arm part 35) of the wire body 34 of the toner crushing wire 30 is positioned at the upper end side 41*b* of the guide portion 41 as indicated by a virtual line of FIG. 5. However, when the cam portion 33*a* of the cam member 33 is separated from the abutting portion 36*c* of the toner crushing wire 30 as illustrated in FIG. 4A, the end portion (the lower end of the first arm part 35) of the wire body 34 of the toner crushing wire 30 moves to the lower end side 41*a* of the guide portion 41 along the guide portion 41 as indicated by a solid line of FIG. 5, so that the elastic portion 35*a* is made to be in pressure-contacted and deformed and thus the wire body 34 is pressed and moves inward in the longitudinal direction.

On the other hand, when the cam portion 33*a* of the cam member 33 pushes up the abutting portion 36*c* (FIG. 4B) from the state in which the cam portion 33*a* of the cam member 33 has been separated from the abutting portion 36*c* of the toner crushing wire 30 (FIG. 4A), the end portion (the lower end of the first arm part 35) of the wire body 34 of the toner crushing wire 30 moves to the state indicated by the virtual line of FIG. 5 from the state indicated by the solid line of FIG. 5, that is, moves to the upper end side 41*b* from the lower end side 41*a* along the guide portion 41, so that the wire body 34 moves outward in the longitudinal direction by restoring force of the elastic portion 35*a*.

By the swing operation of the wire body 34 along the cleansing housing inner wall 25*a* and the reciprocating movement operation in the wire longitudinal direction perpendicular to the direction of the swing operation, it is possible to efficiently and reliably crush remaining toner.

Another Example 2 of Toner Crushing Wire

FIG. 6 illustrates another example 2 of the toner crushing wire 30.

A plurality of undulating portions 34*a* that undulate in the longitudinal direction are provided at the wire body 34 of the toner crushing wire 30 along the rotating shaft 27*a* of the cleaning roller 27.

Consequently, only by the swing operation of the toner crushing wire 30 along the cleansing housing inner wall 25*a*, it is also possible to move remaining toner in the wire longitudinal direction perpendicular to the direction of the swing operation, thereby efficiently and reliably crushing the remaining toner.

What is claimed is:

1. A cleaning device comprising:

a cleaning blade provided in a cleansing housing and brought into press-contact with a peripheral surface of a photosensitive drum to scrape off remaining toner from the peripheral surface, a toner image being formed on the peripheral surface;

a cleaning roller provided in the cleansing housing at an upstream side of a rotation direction of the photosensitive drum from the cleaning blade, and brought into press-contact with the peripheral surface of the photosensitive drum to abrade the peripheral surface of the photosensitive drum by an abrasive included in the scraped-off remaining toner; and a discharge screw provided in the cleansing housing below the cleaning roller to discharge the scraped-off remaining toner outside the cleansing housing as waste toner, wherein, in the cleansing housing, a toner crushing wire, which swings along an inner wall of the cleansing housing facing a peripheral surface of the cleaning roller in non-contact with the inner wall of the cleansing housing and crushes the scraped-off remaining toner, is disposed so as to extend along a rotating shaft of the cleaning roller.

2. The cleaning device of claim 1, wherein elastic portions are provided at both end sides of the toner crushing wire in a longitudinal direction, and a guide portion, which reciprocates the toner crushing wire in the longitudinal direction thereof through pressure deformation of the elastic portions due to a swing operation of the toner crushing wire, is provided to the inner wall of the cleansing housing facing one end of a rotating shaft direction of the cleaning roller.

3. The cleaning device of claim 1, wherein both ends of the rotating shaft of the cleaning roller are respectively supported to device fixing sides via holding members, cam members are respectively fixed to both ends of the rotating shaft, both end sides of the toner crushing wire in the longitudinal direction are respectively supported to the holding members to constitute swing support portions, and vicinities of the swing support portions abut the cam members, so that the toner crushing wire swings by employing the swing support portions as support points by a rotation operation of the cleaning roller.

4. The cleaning device of claim 3, wherein swing urging portions are respectively provided at both ends of the toner crushing wire in the longitudinal direction to abut the device fixing sides.

5. The cleaning device of claim 4, wherein the toner crushing wire includes a conductive wire and is grounded to the device fixing sides.

6. The cleaning device of any one of claims 1, wherein, in the toner crushing wire, a plurality of undulating portions that undulate in the longitudinal direction are provided along the rotating shaft of the cleaning roller.

* * * * *